US008332991B2

(12) United States Patent
Blaak et al.

(10) Patent No.: US 8,332,991 B2
(45) Date of Patent: Dec. 18, 2012

(54) ROBOTIC VACUUM CLEANER HAVING A DISPOSABLE DEBRIS BAG

(75) Inventors: Hans J. Blaak, Leeuwarden (NL); Harrie W. J. Baltussen, Westervoort (NL); Pritesh R. Patel, Groningen (NL); Auke-Jan Veenstra, Roden (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 46 days.

(21) Appl. No.: 13/125,071

(22) PCT Filed: Oct. 26, 2009

(86) PCT No.: PCT/IB2009/054723

§ 371 (c)(1),
(2), (4) Date: Apr. 20, 2011

(87) PCT Pub. No.: WO2010/049874

PCT Pub. Date: May 6, 2010

(65) Prior Publication Data

US 2011/0191977 A1 Aug. 11, 2011

(30) Foreign Application Priority Data

Oct. 31, 2008 (EP) ..... 08168003

(51) Int. Cl.
*A47L 9/14* (2006.01)
*A47L 9/28* (2006.01)

(52) U.S. Cl. ..... 15/319; 15/327.2; 15/339; 15/340.1; 15/DIG. 8

(58) Field of Classification Search ..... 15/319, 15/327.2, 339, 340.1, DIG. 8; *A47L 9/14, A47L 9/28*

See application file for complete search history.

(56) References Cited

U.S. PATENT DOCUMENTS

| | | | |
|---|---|---|---|
| 4,517,705 | A | 5/1985 | Hug |
| 7,395,579 | B2 | 7/2008 | Oh |
| 2002/0174506 | A1 | 11/2002 | Wallach et al. |
| 2005/0251951 | A1 | 11/2005 | Oh et al. |
| 2006/0230721 | A1 | 10/2006 | Oh et al. |
| 2007/0289267 | A1 | 12/2007 | Makarov et al. |

FOREIGN PATENT DOCUMENTS

| | | | |
|---|---|---|---|
| DE | 1156542 | | 10/1963 |
| GB | 2431095 | A | 4/2007 |
| WO | 9321812 | A1 | 11/1993 |
| WO | 2007022959 | A2 | 3/2007 |

*Primary Examiner* — David Redding

(57) ABSTRACT

A robotic vacuum cleaner having a main module and a cleaning head being connected with the main module by means of a suction hose. The main module comprises a debris compartment (8) for accommodating a disposable debris bag (9), which compartment (8) is covered by a hinging cover (18). A hinging part (20) of a suction tube (12) is attached to the hinging cover (18) and a stationary part (21) of the suction tube (12) is connected with an opening (13) to be connected with the suction hose.

3 Claims, 2 Drawing Sheets

ROBOTIC VACUUM CLEANER HAVING A DISPOSABLE DEBRIS BAG

FIELD OF THE INVENTION

The invention is related to a robotic vacuum cleaner having a main module and a cleaning head being connected with the main module by means of a suction hose, whereby the main module comprises a suction unit and a debris compartment, and whereby the suction hose is connected to an opening in the main module, which opening is located near the lower side of the main module.

BACKGROUND OF THE INVENTION

Such robotic vacuum cleaner is disclosed in US-A-2002/0174506. This publication describes an autonomous vacuum cleaner comprising technology that can automate routine household tasks eliminating the need for humans to perform these repetitive and time consuming tasks. The vacuum cleaner can autonomously clean a room while the vacuum cleaner is traveling around on the floor of the room. Thereby, the path of the vacuum cleaner can be controlled based on observations of its environment by cameras or other observation means, such as sonar sensors or infrared sensors. The vacuum cleaner has a main module comprising the suction unit with a vacuum fan as well as a debris collection compartment, being a canister that can be removed from the main module in order to be emptied. The vacuum cleaner comprises also a cleaning head module being connected with the main module by a suction hose, through which suction hose the debris is transported from the cleaning head module to the main module. Then, the debris is collected in the debris collection canister. The suction hose rests on the floor, and therefore the hose is connected to an opening of the main module near its lower side.

It is usual in modern vacuum cleaners to make use of a disposable debris bag instead of a debris canister. Thereby, the debris can be thrown away together with the bag, which is more convenient for the operator of the vacuum cleaner. A vacuum cleaner comprising a debris compartment for accommodating a disposable debris bag is for example disclosed in WO-A-93/21812.

SUMMARY OF THE INVENTION

An object of the invention is a robotic vacuum cleaner having a main module being connected with a cleaning head module by means of a flexible suction hose, whereby the debris compartment contains a disposable debris bag.

An other object of the invention is a robotic vacuum cleaner having a main module being connected with a cleaning head module by means of a flexible suction hose, whereby the debris bag is in a position whereby its opening is at its top side.

An other object of the invention is a robotic vacuum cleaner having a main module being connected with a cleaning head module by means of a flexible suction hose, whereby the debris bag can easily be removed and replaced.

In order to accomplish with one or more of these objects, the top side of the debris compartment is covered by a hinging cover, which hinging cover comprises connection means to be connected to the opening of an upright positioned disposable debris bag, which connection means are attached to the end of a suction tube, while the other end of the suction tube is connected with said opening near the lower side of said main module.

Because the hinging cover is located at the top side of the compartment, i.e. at the higher side of the main module, the debris bag can easily be replaced. Furthermore, the disposable debris bag is positioned upright in the debris compartment, which is a preferred position of the debris bag because the bag can be better filled with debris when its opening is at its higher side.

A non-robotic vacuum cleaner comprising a hinging cover having connection means to be connected to the opening of a disposable debris bag is known. However, thereby the suction hose is connected to an opening in the hinging cover, whereby the cover is difficult to open without disconnecting the suction hose from the vacuum cleaner.

In a preferred embodiment, the suction tube has a flexible portion in order to allow the hinging movement of the cover of the debris compartment. Preferably, the flexible portion is located near the hinging axis of the cover and can be shaped, for example, as a bellows. Such flexible portion ensures that the suction tube is always closed over its length, also when the cover is hinged upwards. There is no need for sealing connection means between the stationary part of the suction tube and the part that moves with the hinging cover.

In another preferred embodiment, the suction tube consist of a first part connected with the hinging cover and a second part connected to the remainder part of the main module, whereby the two parts of the suction tube are connected with each other when the hinging cover is in its closed position. Thereby, the shape of the inner surface of the suction tube can be made in such manner, that there is no restriction in the airflow through the suction tube.

BRIEF DESCRIPTION OF THE DRAWING

The invention will now be further elucidated by means of a description of two embodiments of a robotic vacuum cleaner, whereby reference is made to the drawing comprising diagrammatical figures, whereby.

The figures show only schematically parts that are relevant for the elucidation of the invention.

DETAILED DESCRIPTION OF EMBODIMENTS

Figure 1:
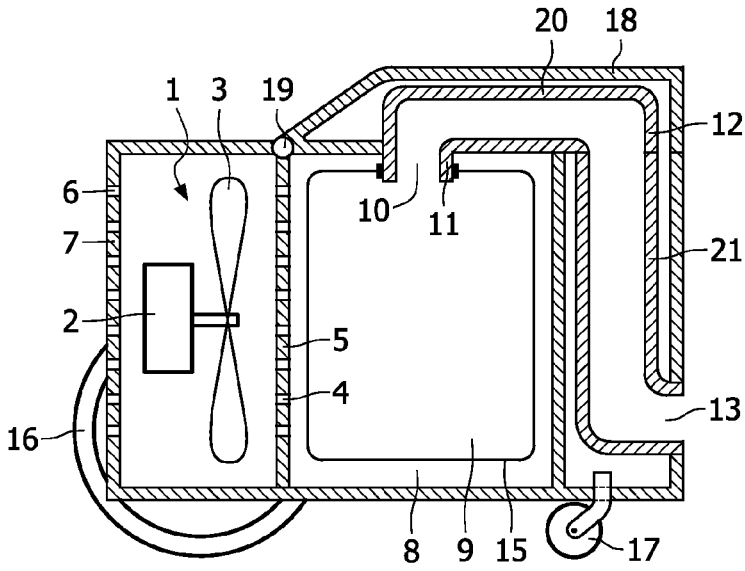
FIG. 1 shows the first embodiment with closed cover.

FIG. 1 is a schematic sectional view of the main module of the first embodiment of a robotic vacuum cleaner. The main module comprises a suction unit 1 having a motor 2 for driving a fan 3. The rotating fan 3 provides for an air flow through the suction unit 1. The air flow enters the suction unit 1 through openings 4 in wall 5 and leaves the suction unit 1 through opening 6 in the outer wall 7 of the main module. Thereby, air is sucked out of the debris compartment 8 of the main unit 1.

A disposable debris bag 9 is present in the debris compartment 8. At its upper side, the debris bag 9 has an opening 10, which opening 10 surrounds the end 11 of a suction tube 12. The other end of the suction tube 12 forms an opening 13 near the lower side of the main module. A flexible suction hose for connecting the main module to a cleaning head can be attached to the opening 13. The suction hose and the cleaning head are not shown in the figures.

When the vacuum cleaner is in operation, the rotating fan 3 creates an air flow from the cleaning head through the flexible suction hose to the opening 13 of the suction tube 12. The air flow continues through the suction tube 12 to the debris bag 9. The air can pass through the material of the flexible wall 15 of the debris bag 9, whereby the debris remains behind in the debris bag 9, in order to be collected. Then the air passes through the openings 4 in wall 5 and the openings 6 in wall 7 in order to leave the main module.

The main module comprises to driven wheels 16 (the figures show only one of these wheels), and a caster wheel 17 that can rotate around a vertical axis. By driving the wheels 16 independently with predetermined speeds, the main module can be moved over the floor in any desired direction during operation of the vacuum cleaner.

Figure 2:
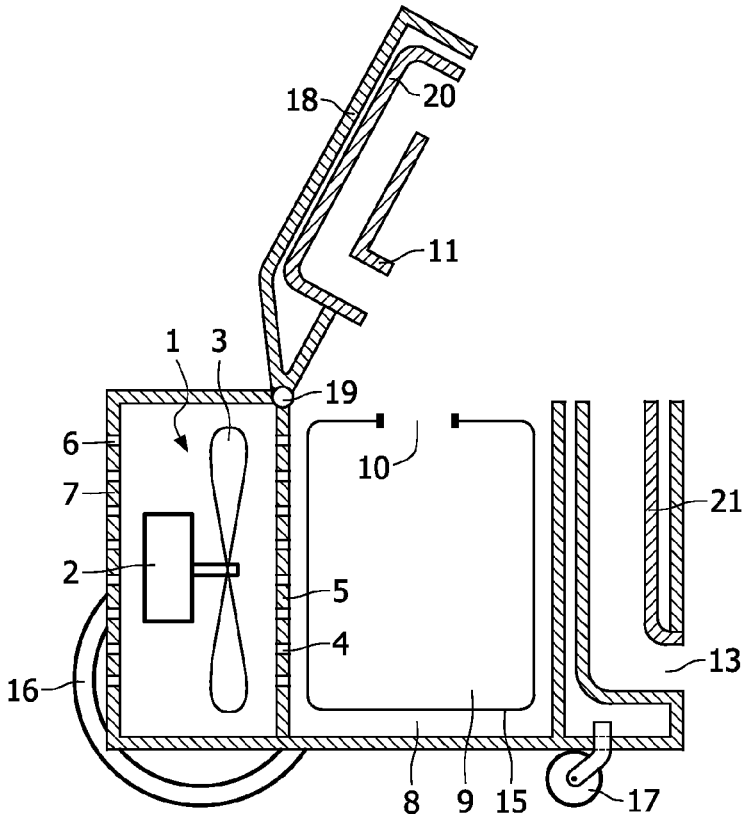
FIG. 2 shows the first embodiment with open cover.

FIG. 2 shows the first embodiment of the main module, whereby the cover 18 of the debris compartment 8 is hinged upwards around its pivot axis 19 in order to remove the debris bag 9 out of the debris compartment 8. A first part 20 of the suction tube 12 is connected to the hinging cover 18 and a second part 21 of the suction tube 12 is stationary fixed in the remainder portion of the main module. When the cover 18 is in its closed position (see FIG. 1), the two parts 20,21 of the suction tube 12 are connected to each other, but when the cover is opened (see FIG. 2) the two parts 20,21 are separated from each other.

The main module comprises means for keeping the opening 10 of the disposable debris bag 9 in its correct position for surrounding the end 11 of suction tube 12 when the cover 18 is moved to its closed position, which means are not shown in the figures, but are known in the art.

Figure 3:
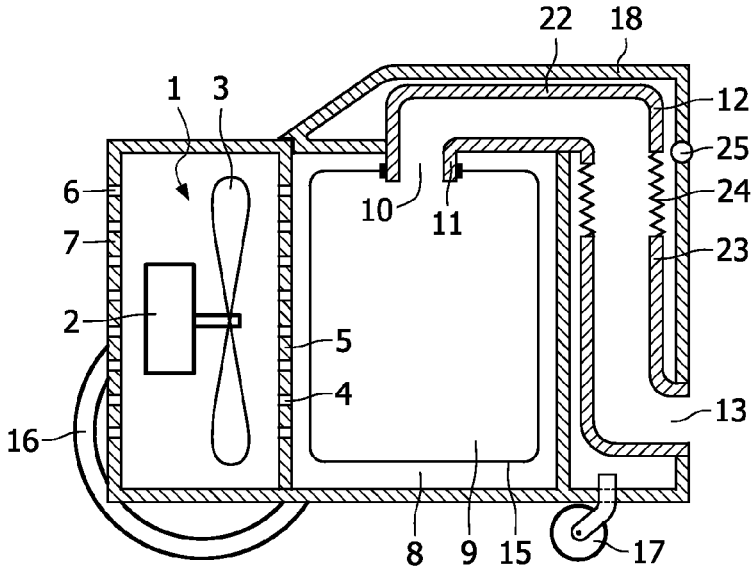
FIG. 3 shows the second embodiment with closed cover.
Figure 4:
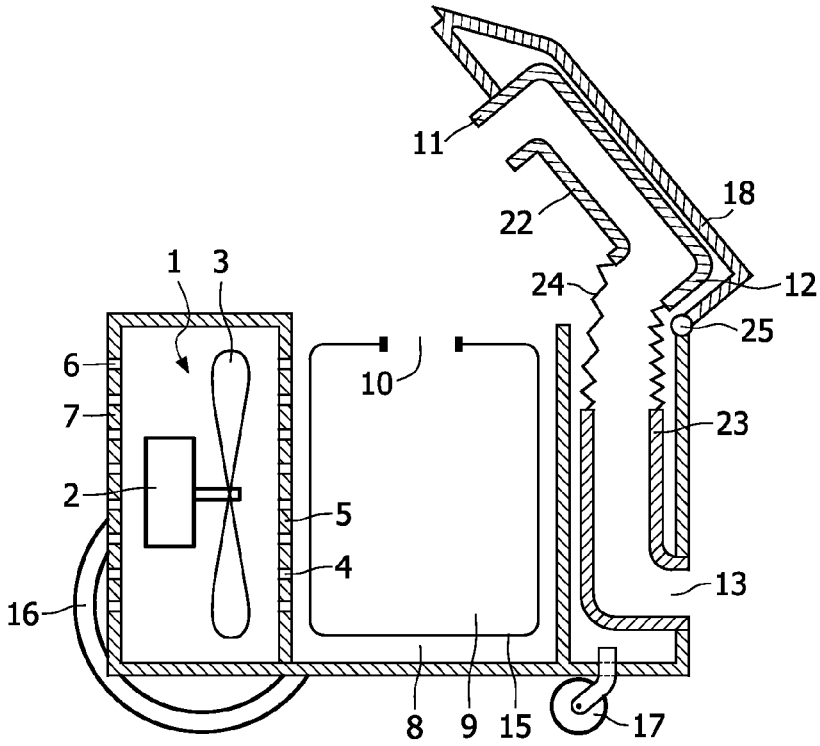
FIG. 4 shows the second embodiment with open cover.

FIG. 3 is a schematic sectional view of the main module of the second embodiment of a robotic vacuum cleaner. Corresponding parts of both embodiments are indicated with the same reference numerals. The suction tube 12 of the second embodiment comprises three parts, a first part 22 connected to the hinging cover 18, a stationary second part 23 and a flexible part 24 connecting the first part 22 and the second part 23. The flexible part 24 is a bellows, so that the first part 22 and the second part 23 can remain connected with each other when the cover 18 of the debris compartment 8 is in its open position (see FIG. 4), whereby the cover 18 is hinged upwards around pivot axis 25.

While the invention has been illustrated in the drawing and the foregoing description, such illustration and description are to be considered illustrative or exemplary and not restrictive; the invention is not limited to the disclosed embodiment. Any reference signs in the claims should not be construed as limiting the scope of the invention.

The invention claimed is:

1. A robotic vacuum cleaner having a main module and a cleaning head being connected with the main module by means of a suction hose, whereby the main module comprises a suction unit (1) and a debris compartment (8), and whereby the suction hose is connected to an opening (13) in the main module, which opening (13) is located near the lower side of the main module, characterized in that the top side of the debris compartment (8) is covered by a hinging cover (18), which hinging cover (18) comprises connection means to be connected to the opening (10) of an upright positioned disposable debris bag (9), which connection means are attached to the end (11) of a suction tube (12), while the other end of the suction tube (12) is connected with said opening (13) near the lower side of said main module.

2. A vacuum cleaner as claimed in claim 1, characterized in that the suction tube (12) has a flexible portion (24) in order to allow the hinging movement of the cover (18) of the debris compartment (8).

3. A vacuum cleaner as claimed in claim 1, characterized in that the suction tube (12) consist of a first part (20) connected with the hinging cover (18) and a second part (21) connected to the remainder part of the main module, whereby the to parts (20,21) of the suction tube (12) are connected with each other when the hinging cover (18) is in its closed position.

* * * * *